US007484249B1

(12) United States Patent
Reese et al.

(10) Patent No.: US 7,484,249 B1
(45) Date of Patent: Feb. 3, 2009

(54) APRON WITH BEVERAGE HOLDER

(75) Inventors: Quincy Reese, Brockton, MA (US); Mark T. Salander, Barrington, RI (US)

(73) Assignee: The Gem Group, Inc., Lawrence, MA (US)

( * ) Notice: Subject to any disclaimer, the term of this patent is extended or adjusted under 35 U.S.C. 154(b) by 0 days.

(21) Appl. No.: 11/850,422

(22) Filed: Sep. 5, 2007

(51) Int. Cl.
*A41D 13/04* (2006.01)

(52) U.S. Cl. ..... 2/48; 2/51

(58) Field of Classification Search ..... 2/48, 2/49.1–49.5, 50, 51, 52, 247, 102, 94, 248, 2/250, 254, 93, 85, 88, 108, 114; 224/148.1, 224/148.3, 148.4, 148.7, 148.5; D2/861, D2/863, 864
See application file for complete search history.

(56) References Cited

U.S. PATENT DOCUMENTS 298,985 A * 5/1884 Kimball ..... 2/49.2
2,364,258 A * 12/1944 Wallace ..... 2/92
2,461,390 A * 2/1949 Montague ..... 2/250
2,472,286 A * 6/1949 Drasnin ..... 2/247
3,428,962 A * 2/1969 Slimovitz ..... 2/48
D270,091 S * 8/1983 Setzer ..... D24/127
5,228,140 A * 7/1993 Baustin ..... 2/93
5,509,141 A * 4/1996 Saltzman ..... 2/49.2
5,566,391 A * 10/1996 Williamson ..... 2/51
5,607,412 A * 3/1997 Brown ..... 2/46
D381,190 S * 7/1997 Deon ..... D2/863
5,843,054 A * 12/1998 Honig ..... 604/345
5,909,802 A * 6/1999 Puco et al. ..... 2/102
5,960,471 A * 10/1999 Burton ..... 2/48
6,745,399 B1 * 6/2004 Austin ..... 2/49.1
6,839,907 B2 * 1/2005 Katz ..... 2/48
2001/0032867 A1 * 10/2001 Silbert ..... 224/148.5
2006/0037982 A1 * 2/2006 Lesser ..... 224/148.4
2007/0163028 A1 * 7/2007 Brauner et al. ..... 2/175.7
2007/0266477 A1 * 11/2007 Cunliffe ..... 2/209.13
2008/0201817 A1 * 8/2008 Ostrander ..... 2/52

* cited by examiner

*Primary Examiner*—Amy B Vanatta
(74) *Attorney, Agent, or Firm*—William A. Loginov; Loginov & Associates PLLC

(57) ABSTRACT

This invention provides an apron having at least one beverage pocket specifically designed for holding beverage containers at a convenient location for easy access by the user. The pocket includes a reinforced outer rim, formed from a durable polymer ring or gusset in an illustrative embodiment. In one implementation, the pocket is located along the lower end of a side wing of the apron so that it is generally below and within easy reach of the wearer's right (or left) hand. The ring/gusset secures an appropriately sized inner beverage pocket pouch that has a depth and perimeter size sufficient to house an average-sized beverage container. The depth of is arranged so that the top of an average container either protrudes slightly, or is completely recessed within the pouch. The pouch may be constructed from one or more layers of insulating material to allow the drink to retain its heat or coolness and preventing transfer of heat/cold to the wearer's body. In an illustrative embodiment, the apron can also include additional convenient features, such as a retractable, lanyard-mounted bottle opener. The retractable cord/lanyard-mounted bottle opener is placed within easy reach of the user, and may be located on the same side of the apron as the pocket, at a position above the pocket, in this embodiment.

9 Claims, 7 Drawing Sheets

APRON WITH BEVERAGE HOLDER

FIELD OF THE INVENTION

This invention relates to aprons for cooking, more particularly to aprons worn for barbeques.

BACKGROUND OF THE INVENTION

Aprons are one of the most popular accessories used by cooks and barbecue enthusiasts. They allow ones clothes to remain clean, even while working around messy food preparation areas where grease and other permanently staining substances are likely to be encountered. Many barbeque aprons feature durable fabric with pockets and a variety of adjustable straps to allow the he apron to accommodate wearers of various sizes. There is typically one strap that is worn around the neck and often another strap worn around the back of the body near the waist or mid torso. In this manner, the apron is easily put on and removed as needed, but still held securely.

Aside from changes in materials and strap arrangements, aprons have changed little over the years. However, new and improved features that can add further conveniences to the wearer are highly desired.

SUMMARY OF THE INVENTION

This invention overcomes the disadvantages of the prior are by providing an apron having at least one beverage pocket specifically designed for holding beverage containers at a convenient location for easy access by the user. The beverage pocket includes a reinforced outer rim, formed from a durable polymer ring or gusset in an illustrative embodiment. In one implementation, the pocket is located along the lower end of a side wing of the apron so that it is generally below and within easy reach of the wearer's right (or left) hand. The ring/gusset secures an appropriately sized inner beverage pocket pouch that has a depth and perimeter size sufficient to house an average-sized beverage container. The depth of the pocket may be arranged so that the top of an average container either protrudes slightly, or is completely recessed within the pouch. The pouch may be constructed from one or more layers of insulating material to allow the drink to retain its heat or coolness and preventing transfer of heat/cold to the wearer's body. In an illustrative embodiment, the apron can also include additional convenient features, such as a retractable, lanyard-mounted bottle opener. The retractable cord/lanyard-mounted bottle opener is placed within easy reach of the user, and may be located on the same side of the apron as the pocket, at a position above the pocket, in this embodiment.

BRIEF DESCRIPTION OF THE DRAWINGS

The invention description below refers to the accompanying drawings, of which.

DETAILED DESCRIPTION

Figure 1:
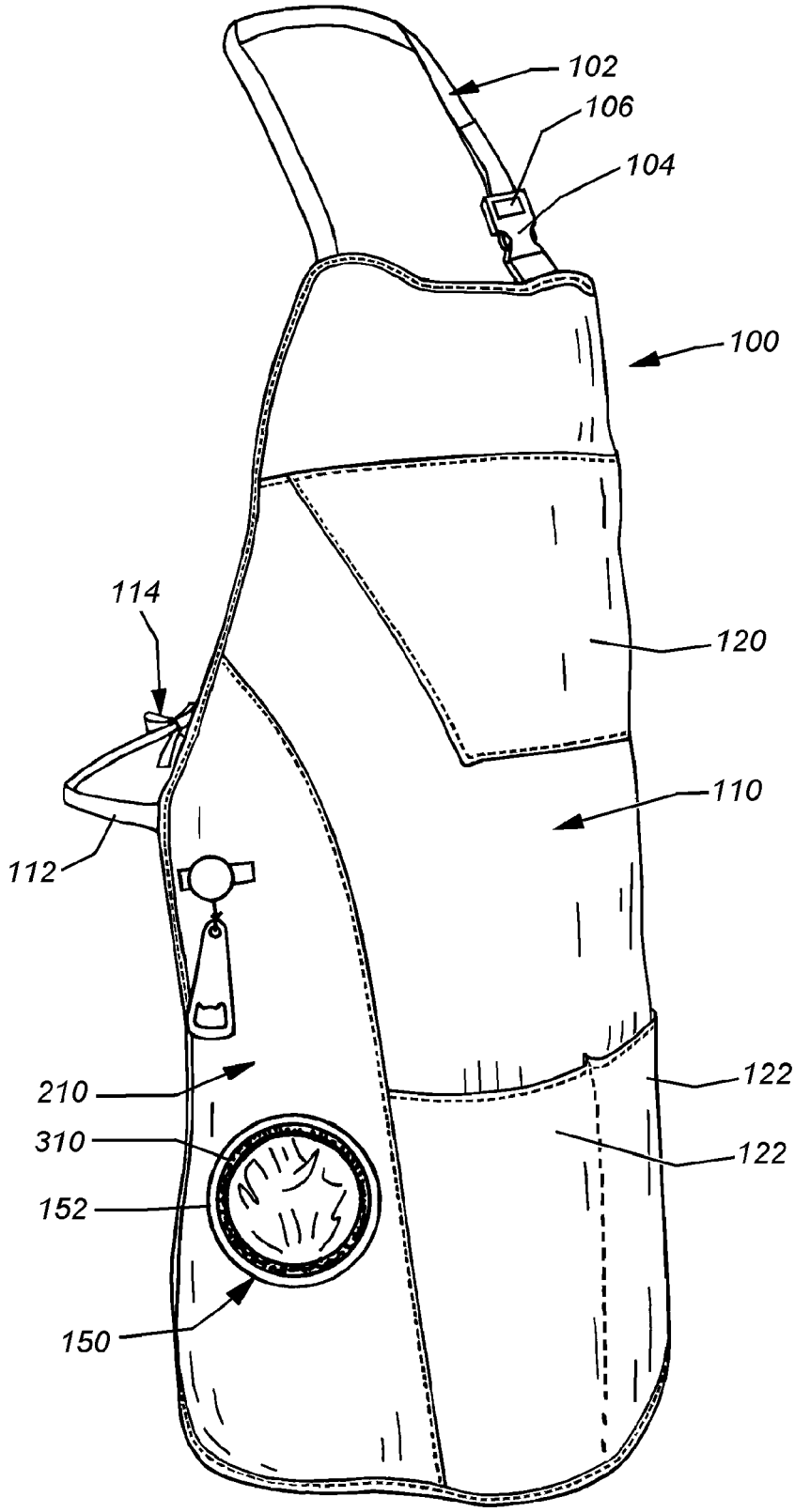
FIG. 1 is a side perspective view of an apron having a beverage-containing pocket and a lanyard-mounted opener according to an embodiment of this invention.

FIG. 1 shows an apron 100 according to an embodiment of this invention. The apron includes a neck strap 102 having a removable buckle assembly 104 with an adjustment loop 106 that allows the over-all size of the strap 102 to be varied to accommodate different users. Approximately midway down the main body 110 of the apron are a pair of waist straps 112 that extend around the rear of the apron. These straps are tied together at a user-defined knot 114 to allow the apron to conform closely to the shape of the wearer's torso and mid-section. The apron 100 includes a reinforcing panel 120 that can be constructed in a differing style or color of material than the surrounding apron body. This panel and any other ornamentation, applied logos or patterns are optional features. Likewise, at least two bottom pockets 122 are provided on the main apron body 110 for holding utensils, barbeque tools and other cooking accessories. These pockets are also optional, and can be constructed from contrasting materials where appropriate.

Figure 2:
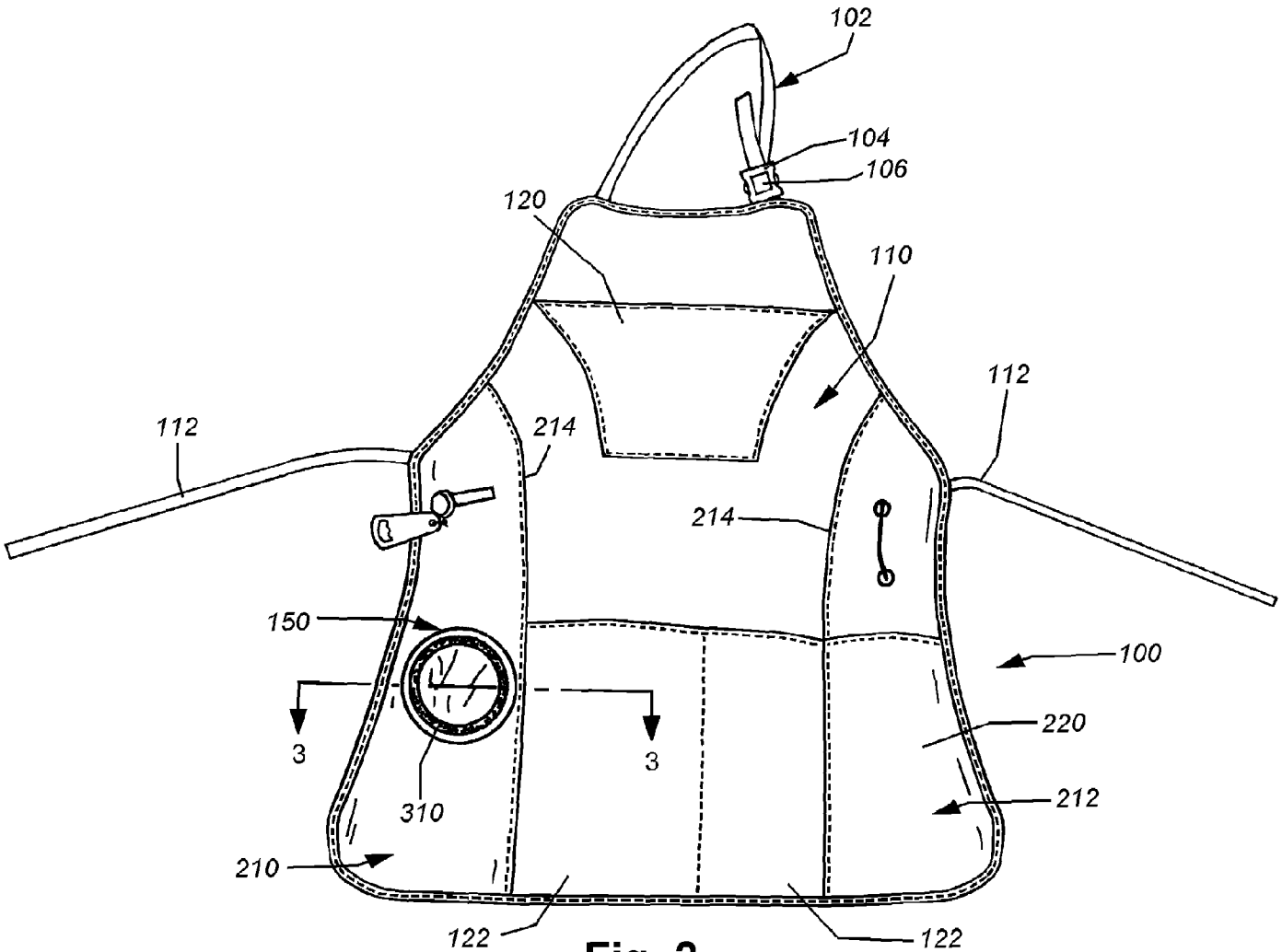
FIG. 2 is a front view of the apron of FIG. 1 with the body straps untied.

With further reference to FIG. 2, the apron includes side wings 210 and 212 attached by stitching 214 or, another attachment mechanism, to the main body 110. In practice, the main body 110 can define a continuous piece of material that defines both the side wings 212, 214 and the main body 110. Alternatively, the wings 210 and 212 comprise additional material pieces that are located over the underlying body material. Note that the side wing 212 includes a further bottom pocket 220 that is stitched over the base material of the side wing. This bottom pocket 220 counterbalances the beverage pocket on the wing 210 which will now be described in further detail.

Figure 3:
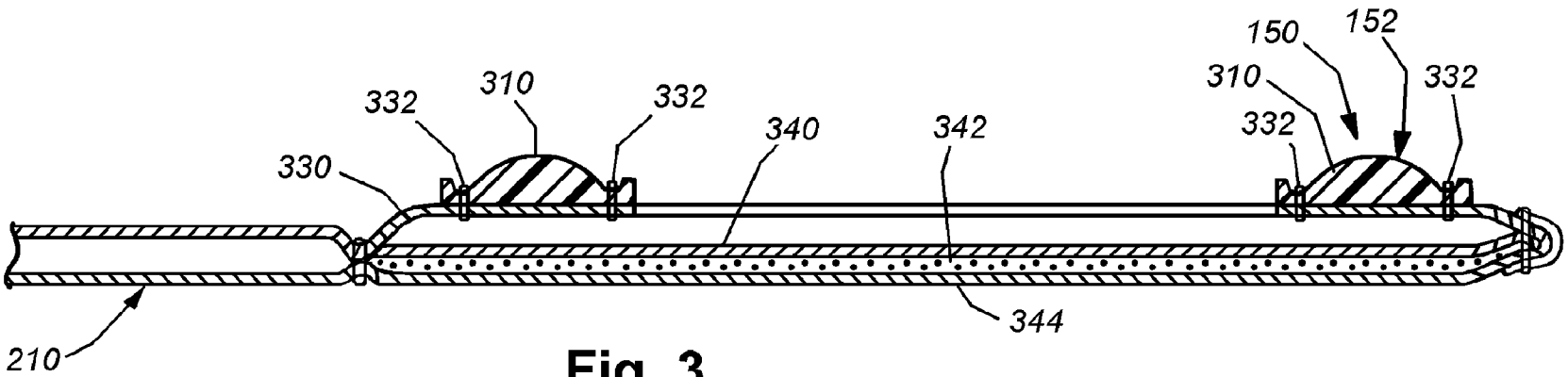
FIG. 3 is a partial cross-section of the pocket taking along line 3-3 of FIG. 2.
Figure 4:
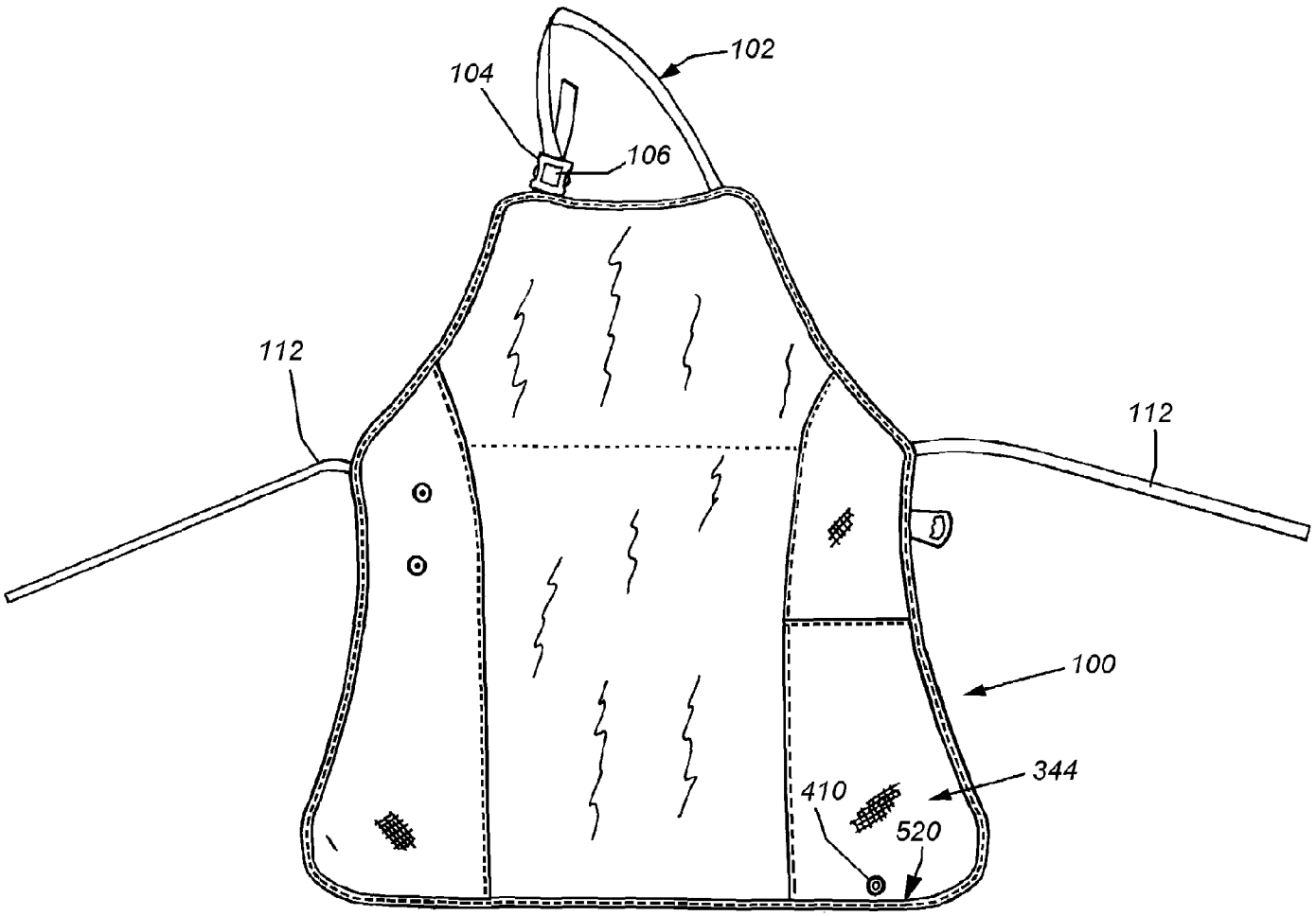
FIG. 4 is a rear view of the apron of FIG. 1 with the body straps untied.
Figure 5:
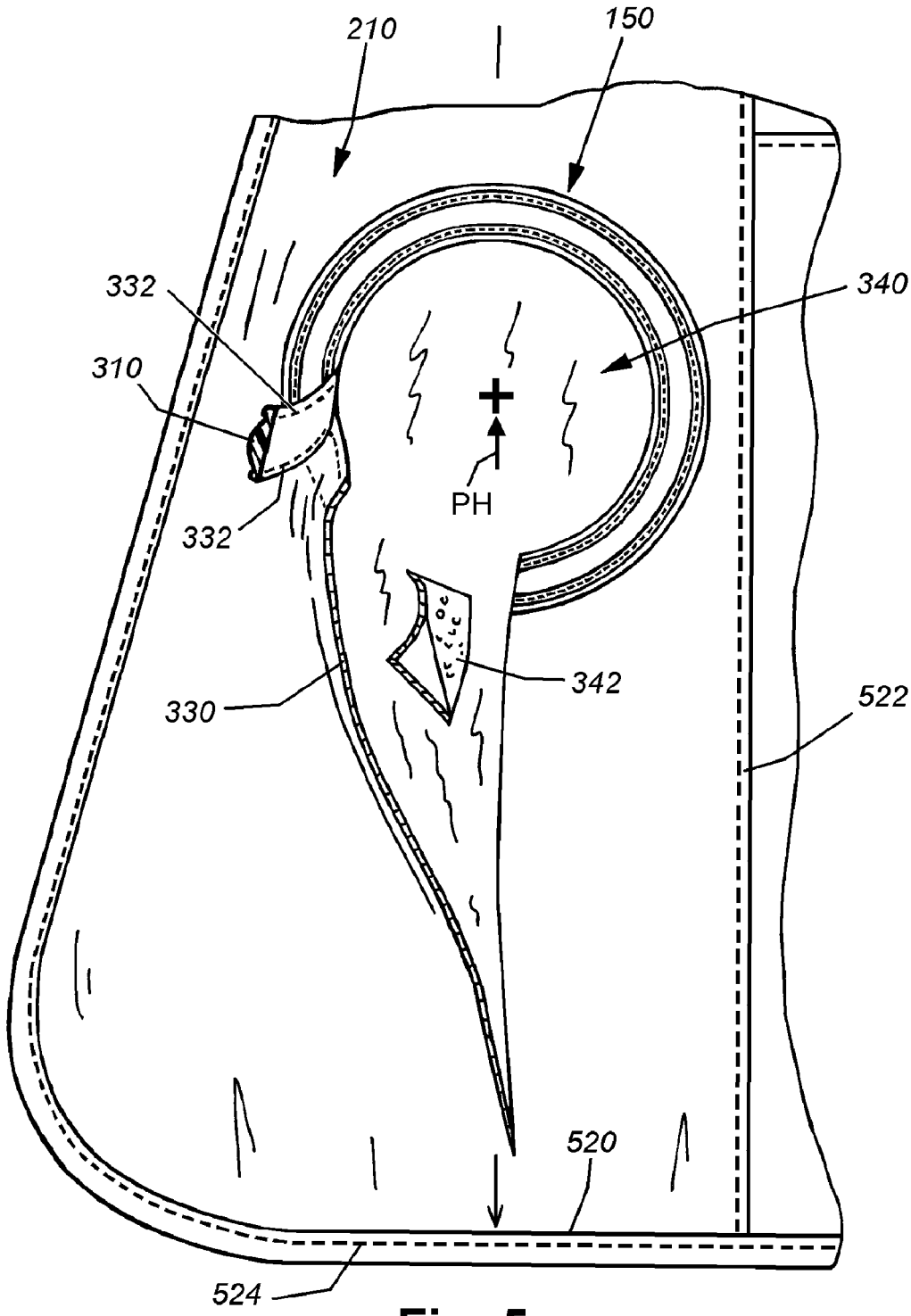
FIG. 5 is a cut-away view of the various layers of the pocket.

With reference also to FIGS. 3-5, the apron includes, near the bottom of the side wing 210, an inventive beverage pocket assembly 150. The pocket assembly 150 includes an opening 152 that is circular in this embodiment. It has a diameter of between approximately three and six inches (3½ inches in an illustrative embodiment), in part depending upon the maximum size of beverage container to be contained. While the opening 152 is circular in this example, it can be any acceptable shape that accommodates the desired container. As shown particularly in the cross section of FIG. 3, the beverage pocket opening 152 includes a reinforced opening ring or gusset 310. The ring/gusset 310 provides a sturdy portal through which beverages can be inserted and removed that reduces the risk of tearing. The ring/gusset 310 can be constructed from and elastomeric material, like rubber, soft polyvinyl chloride (PVC) or another durable and pliable material. Various indicia, embossed or debossed decorations and/or logos can be applied to the surface of the ring/gusset 310. As shown, the ring/gusset 310 is attached to the top material layer 330 of the apron side wing 210 by stitching 332. In alternate embodiments, adhesives or other attachment mechanisms can be employed to secure the ring/gusset to the underlying apron material.

The inner layer 340 of the beverage pocket consists of a waterproof, insulating material, such as PET. It can be provided with a silver or reflective surface to further insulate the pocket. In an illustrative embodiment, the beverage pocket's inner layer 340 is backed by an insulating layer 342. For the purposes of this description, the insulating material can comprise any material, including a foam, a gel or an airspace, that affectively reduces transfer of heat across a boundary formed by the inner layer 340. As shown, the insulating material 342 is further backed by the rear layer 344 (i.e. the rear face material) of the side wing 210. The rear layer 344 material can be a continuation of the apron's overall rear face. This rear layer 344 is shown in further detail in FIG. 4. In particular, the material of the rear layer 344 can be a comfortable, breathable material, such as woven cotton or canvas. Alternately, the rear layer material can be a synthetic fabric. In general, the materials used for the outer portions of the apron are durable, easy to clean and reasonably lightweight for added wearing comfort.

Reference is now made generally to the cutaway view of the beverage pocket as shown in FIG. 5. The approximate height of the pocket PH from the center of the beverage pocket opening 152 the pocket bottom 520 is highly variable. In this embodiment PH is approximately 8¼ inches. The beverage pocket is typically sized so that the majority of a drink beverage can be securely contained within the pocket without becoming "lost" in the pocket's volume and thereby difficult to retrieve easily. In this manner, it is relatively easy for the wearer to withdraw the drink when needed, but it is mostly contained by the pocket so it will be insulated and not otherwise fall out of the pocket as the wearer moves around. In one embodiment, the height PH is approximately six inches and twelve inches. The bottom 520 of the beverage pocket, as well as the pocket's side walls, are each formed by the stitching 522, 524 between material layers of the side wing 210. In alternate embodiments, the internal volume beverage pocket can be further restricted by additional internal stitching between the back layer 340 and the covering layer 330. This may be desirable in preventing a beverage container from tipping within the pocket.

Note as shown in FIG. 4, an optional metal or plastic grommet 410 provided near the bottom 520 of the pocket. In this embodiment, the grommet has an opening diameter of approximately one-quarter and one-half inch. This grommet is adapted to allow moisture to weep from the bottom of the beverage pocket so that moisture from condensation or spillage does not accumulate. The grommet can be located on the front of the apron in alternate embodiments. In further embodiments, grommets can be provided at other locations on either the front and/or rear of the pocket.

Figure 6:
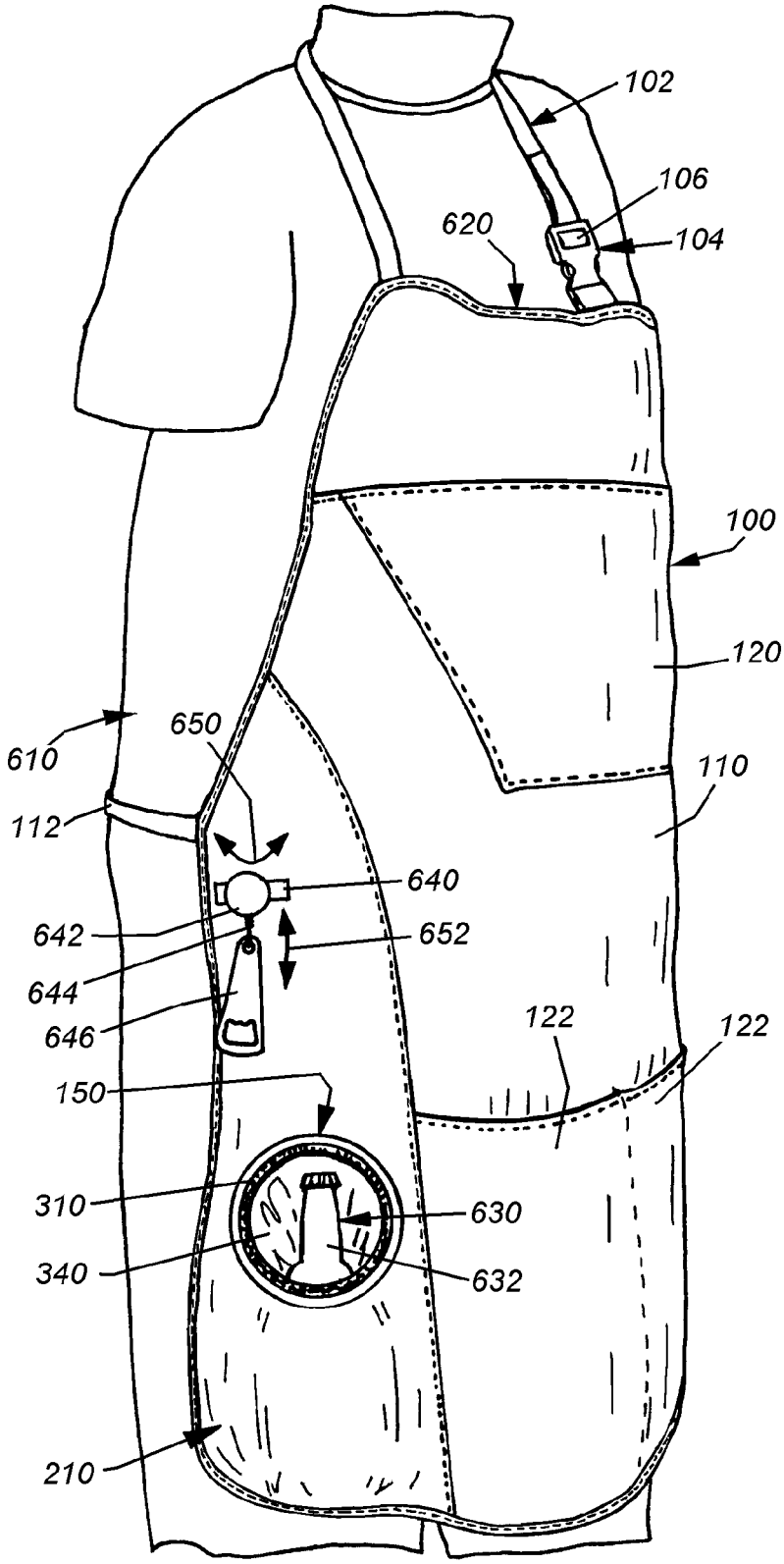
FIG. 6 is a side perspective view of the apron worn on the body of a wearer and including a beverage bottle within the pocket.
Figure 7:
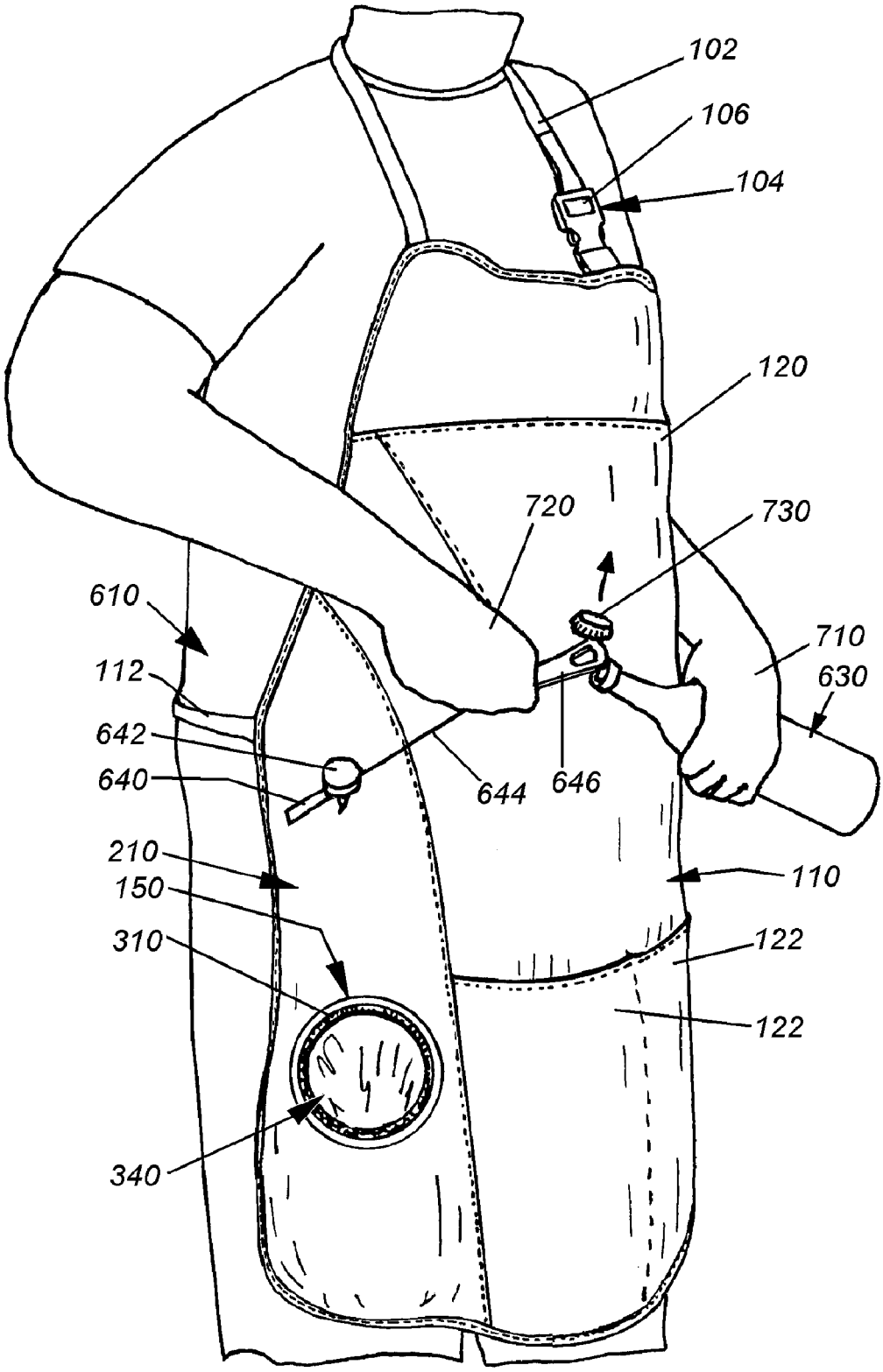
FIG. 7 is a side perspective view of the apron worn on the body of a wearer showing the bottle of FIG. 6 removed by the wearer from the pocket and being opened by the opener.

Reference is now made to FIGS. 6 and 7, which show the apron in operation on an exemplary wearer 610. The wearer has the neck strap 102 properly adjusted around his or her neck so that the top 620 of the apron is positioned appropriately with respect to his or her body. The body or waist straps 112 have been tied so that the apron fits snugly around the wearer's body. A bottled beverage 630 has been placed within the beverage pocket with the bottle's neck 632 projecting into the opening of the pocket. In this orientation, it is easily reachable by a user, while it is still snuggly retained against spilling and otherwise insulated.

A loop 640 is provided above the beverage pocket opening 152. The loop retains a plastic or metal winder 642 similar in form to a spring-loaded tape measure. The winder retains a coil of durable cordage 644 to which is attached at metal bottle opener 646 of relatively conventional design. The loop 640 is conventionally mounted on the side wing 210 at a position above the beverage pocket opening 152. The loop allows rotational (curved arrow 650) movement of the winder 642, while the winder allows extension (double arrow 652) of the cord or lanyard 644 and opener 646. The winder, because of the spring loaded, exerts tension on the cord at all times, causing to retract when releases. In one embodiment, the lanyard extends a maximum distance of approximately 25-26 inches. As now shown in FIG. 7, the wearer 610 has withdrawn the bottle 630 with his or her hand 710 and has grasped and extended the opener 646 with his or her opposing hand 720. The opener removes the bottle top 730 in a conventional manner, allowing user to enjoy the beverage. After some of the beverage has been consumed, it can be returned to the apron's beverage pocket until again desired.

It should be clear from the description above that a useful and desirable feature has been provided to the apron of this invention. This feature affords the wearer more freedom of movement, better storage for beverages and ensures that such beverages will remain cooler and less likely to be spilled.

The foregoing has been a detailed description of illustrative embodiments of the invention. Various modifications and additions can be made without departing from the spirit and scope if this invention. Each of the various embodiments described above may be combined with other described embodiments in order to provide multiple features. Furthermore, while the foregoing describes a number of separate embodiments of the apparatus and method of the present invention, what has been described herein is merely illustrative of the application of the principles of the present invention. For example, the apron can include a variety of applied decorations, printing, logos or monograms. Additionally, while a single beverage pocket is shown. It is expressly contemplated that an additional beverage pocket of a similar or differing construction can be provided on the opposing side wing of the apron. Further beverage pockets or other useful structures can be provided to other locations on the apron. Likewise, wile a beverage pocket is provided on the side wing for ease of reach, and to afford a less interfering/obtrusive position, one or more beverage pockets in accordance with this invention can be provided at any acceptable location on the apron in alternate embodiments. Accordingly, this description is meant to be taken only by way of example, and not to otherwise limit the scope of this invention.

What is claimed is:

1. An apron comprising:

an apron body including a neck strap and a waist strap assembly, the apron body comprised of a top layer and a rear layer; and a beverage pocket defining an opening along the top layer of the apron body and including a pouch that extends between the top layer and the rear layer of the apron body, the pocket being constructed and arranged to receive a beverage container thereinto with a portion of the beverage container adjacent to or projecting from the opening so as to allow selective removal of the beverage container from the beverage pocket by a wearer of the apron, the opening including a reinforcing gusset applied to the apron body, wherein the gusset comprises an elastomeric material and defines an approximately circular shape.

2. The apron as set forth in claim 1 wherein the beverage pocket includes on a portion thereof an insulating material between the layers.

3. The apron as set forth in claim 1 wherein the beverage pocket is located on a side wing of the apron body constructed and arranged to be located beneath an arm of the wearer.

4. The apron as set forth in claim 3 wherein the beverage pocket includes on a portion thereof an insulating material between the layers.

5. The apron as set forth in claim 3 wherein the apron body includes an opposing side wing having a utensil pocket opposite the side wing having the beverage pocket.

6. The apron as set forth in claim 1 wherein the pocket includes on a portion thereof a drain grommet through which moisture from the beverage, container drains, when the beverage container is contained within the pocket.

7. The apron as set forth in claim 1 wherein the pocket includes on a portion thereof an insulating material between the top layer and the bottom rear layer and a drain grommet through which moisture from the beverage container drains, when the beverage container is contained within the pocket.

8. The apron as set forth in claim 1 further comprising a loop disposed on the apron body constructed and arranged to retain a retractable cord.

9. The apron as set forth in claim 8 further comprising a bottle opener attached to the retractable cord.

* * * * *